US007987534B2

(12) United States Patent
Lin

(10) Patent No.: US 7,987,534 B2
(45) Date of Patent: Aug. 2, 2011

(54) SHOWER CURTAIN ROD

(76) Inventor: Mei-Chun Lin, Taipei (TW)

( * ) Notice: Subject to any disclaimer, the term of this patent is extended or adjusted under 35 U.S.C. 154(b) by 343 days.

(21) Appl. No.: 12/266,866

(22) Filed: Nov. 7, 2008

(65) Prior Publication Data

US 2010/0115694 A1 May 13, 2010

(51) Int. Cl.
*A47K 3/022* (2006.01)

(52) U.S. Cl. ..... 4/608; 4/557; 4/558

(58) Field of Classification Search ..... 4/608, 609, 4/610, 557, 558, 576.1; 211/105.3, 87.01; 248/206.3, 220.1, 264, 261; 16/87.4 R; 160/349.1, 160/330

See application file for complete search history.

(56) References Cited

U.S. PATENT DOCUMENTS 2,011,662 A * 8/1935 Thompson ..... 4/558
5,706,878 A * 1/1998 Guettler ..... 160/369
6,263,523 B1 * 7/2001 Moore ..... 4/610
6,502,794 B1 * 1/2003 Ting ..... 248/206.2
6,688,479 B2 * 2/2004 Nei ..... 211/105.2
7,346,940 B1 * 3/2008 Liao ..... 4/558
2005/0268394 A1 * 12/2005 Monk et al. ..... 4/558
2006/0026748 A1 * 2/2006 Kwok ..... 4/576.1
2007/0169260 A1 * 7/2007 Huang ..... 4/558
2007/0174956 A1 * 8/2007 Heaslip ..... 4/558
2008/0022451 A1 * 1/2008 Urlich et al. ..... 4/610
2008/0028513 A1 * 2/2008 Didehvar ..... 4/610
2008/0115265 A1 * 5/2008 Heaslip ..... 4/610
2009/0020671 A1 * 1/2009 Xu ..... 248/262

* cited by examiner

*Primary Examiner* — Khoa D Huynh

(74) *Attorney, Agent, or Firm* — Alan Kamrath; Kamrath & Associates PA

(57) ABSTRACT

A shower curtain rod is a multiple-sectional rod composed of two supporting rods and at least one extension rod pivotally connected between the two supporting rods to allow shower curtain sleeving and suspending thereon. Distal ends of the two supporting rods rotatably combine with pivotal hinge assemblies to mount on the walls respectively. Thus, the extension rod is driven to different orientations by pushing and rotating one of the two supporting rods to selectively bend the shower curtain rod inward or outward to make the shower space variable with maximum benefit.

2 Claims, 7 Drawing Sheets

SHOWER CURTAIN ROD

BACKGROUND OF THE INVENTION

1. Field of the Invention

The present invention relates to a shower curtain rod and, more particularly, to a shower curtain rod composed of multiple sections pivotally connecting one by one in sequence and, thus, enabled to curve inward or outward for different orientation changes.

2. Description of Related Art

A shower curtain is set in a shower room for covering or separating spaces when people take showers. Therefore, the shower curtain with its suspension rod is preferred to be retractable, since it is used temporarily during shower time. It is important to make the shower curtain collectable and extendable easily and is especially important for a design of a shower space inside a recreational vehicle (RV), beach wagon, camping car, caravan and estate car.

In the design of the conventional shower curtain structure, it is mainly a fixed type to attach a shower curtain rod on the walls to hang a shower curtain thereon (depending on the corresponding angle and distance between two opposite walls, the shower curtain rod is usually arc-shaped or rod-shaped). Although the shower curtain can be retracted or extended by pulling to slide on the rod, the shower curtain rod still keeps the same shape in the form of an outward arc or of being straight. Therefore, the shower space is unchangeable. This drawback only causes slight inconvenience in the bathroom inside a house but is significant to the shower space inside traveling cars such as camping cars, because the total space therein is limited to set all functional rooms such as kitchen, bedroom, etc. Therefore, the feasibility of little space is crucial so that the conventional shower curtain rod is not suitable for camping cars in application.

SUMMARY OF THE INVENTION

A main objective of the present invention is to provide a shower curtain rod composed of multiple sections pivotally connected one by one in sequence to change different structure arrangements to create more space variation inside a shower room in use.

To achieve the foregoing objective, the shower curtain rod comprises:

two supporting rods adapted to respectively pivotally attach to walls; and at least one extension rod pivotally connected between the two supporting rods.

By having the above structure, the shower curtain rod is enabled to bend inward or outward to create more space flexibility.

Further benefits and advantages of the present invention will become apparent after a careful reading of the detailed description with appropriate reference to the accompanying drawings.

DETAILED DESCRIPTION OF THE PREFERRED EMBODIMENT

A shower curtain rod in accordance with the present invention is a multiple-sectional rod composed of two supporting rods and at least one extension rod pivotally connected between the two supporting rods to allow shower curtain sleeving and suspending. Distal ends of the two supporting rods rotatably combine with two pivotal hinge assemblies to mount on the walls respectively. Thus, the extension rod is driven to different orientations by pushing one of the supporting rods to selectively bend the shower curtain rod inward or outward to make the shower space variable with maximum benefit.

Figure 1:
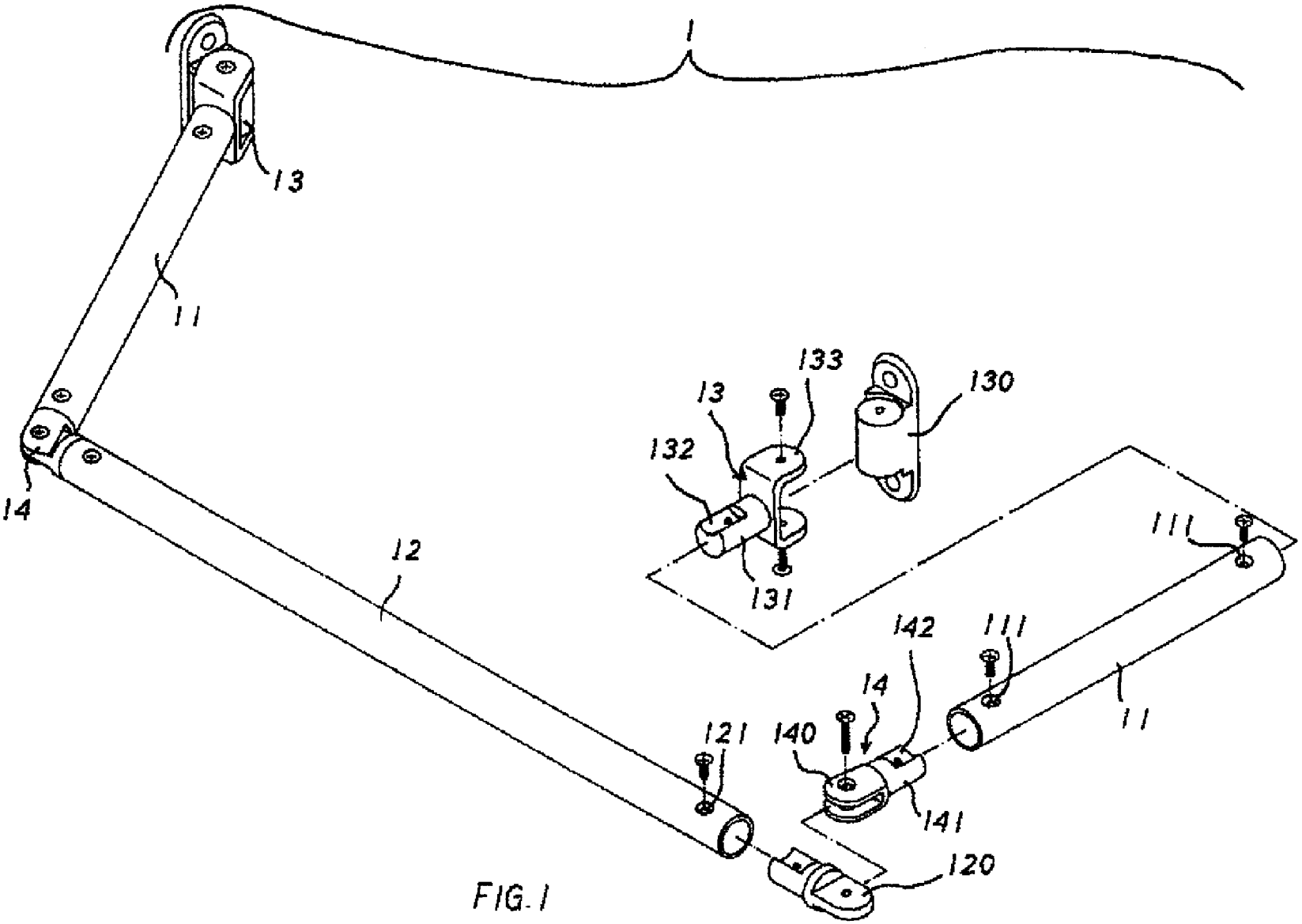
FIG. 1 is a partially exploded perspective view of a shower curtain rod in accordance with the present invention.
Figure 2:
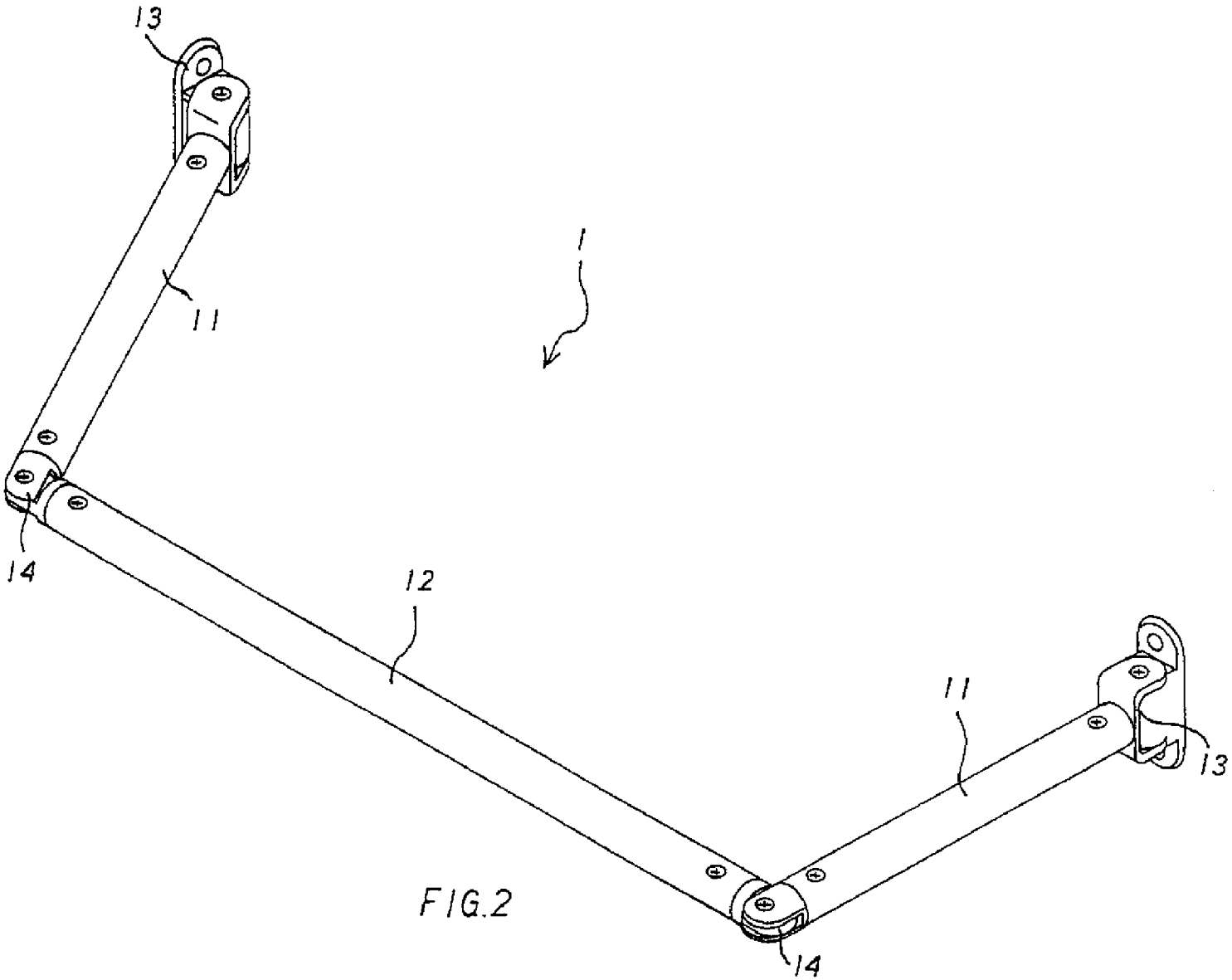
FIG. 2 is a perspective view of the shower curtain rod in FIG. 1.
Figure 3:
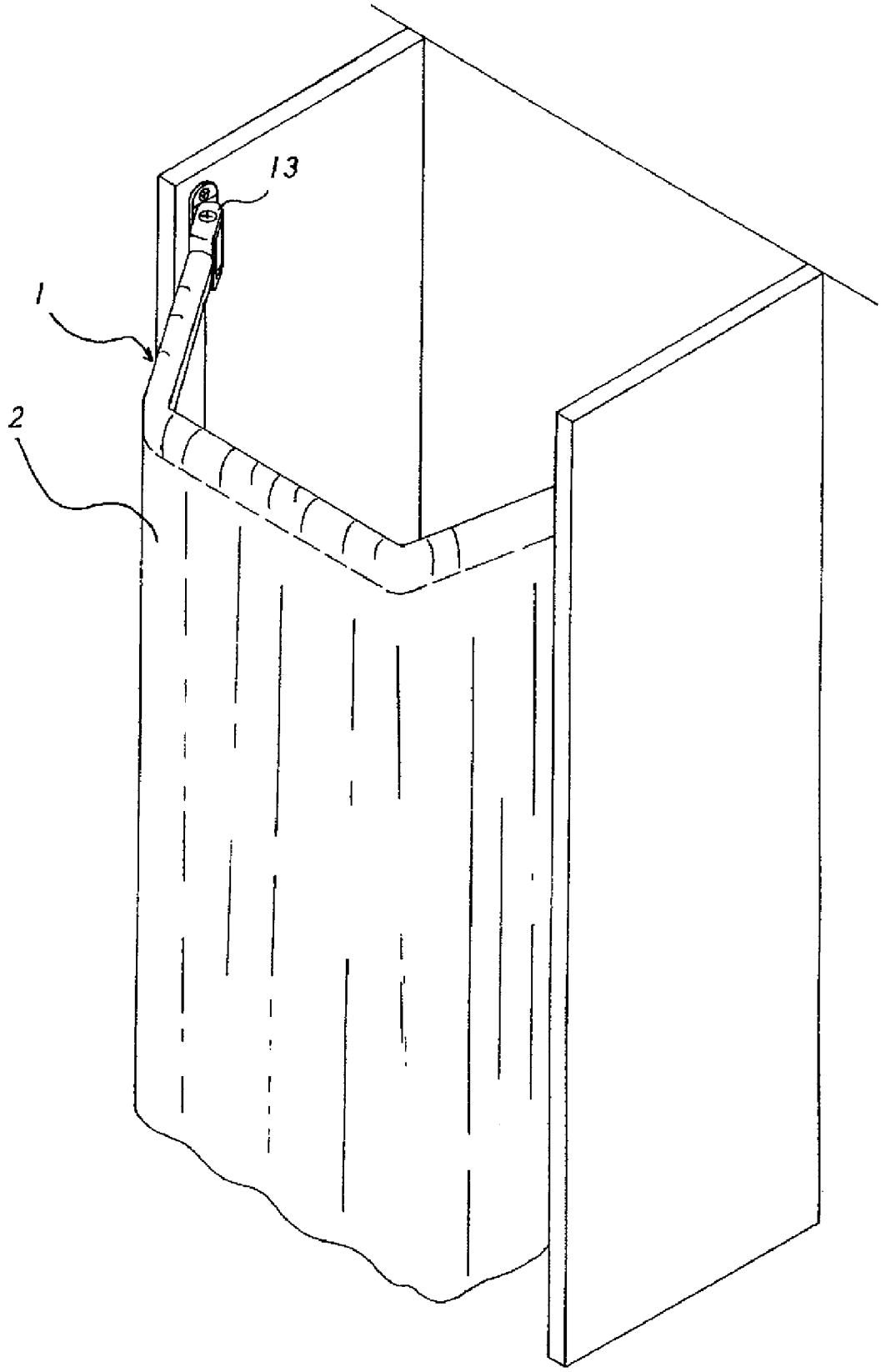
FIG. 3 is a perspective view of the shower curtain rod, wherein a shower curtain is suspended on the shower curtain rod in use.

With reference to FIGS. 1 and 2, a preferred embodiment of the shower curtain rod 1 comprises two supporting rods 11 pivotally bridged with an extension rod 12 by two pivoting joints 14 to allow a shower curtain 2 sleeving and suspending on the shower curtain rod 1 (as shown in FIG. 3). Each pivoting joint 14 has a bracket end 140 pivotally clamping a distal flattened head 120 of the extension rod 12, and an insertion end 141 extending from the bracket end 140 and inserted into a corresponding end of one of the two supporting rods 11. The flattened head 120 of the extension rod 12 is formed by a plug with two flat wings (not numbered). One flat wing is inserted into the corresponding end of the extension tube 12 and is secured on the extension tube 12 by a screw, and the other flat wing is clamped by the bracket end 140. Distal ends of the two supporting rods 11 are rotatably and respectively fixed to walls by two pivotal hinge assemblies. Each pivotal hinge assembly comprises a pivotal post 130 adapted to mount on the wall and a connecting joint 13 with a bracket end 133 clamping the pivotal post 130 and an insertion end 131 inserted into a corresponding distal end of one of the two supporting rods 11. Thereby, the extension rod 12 is operationally driven to different orientations along with one supporting rod 11 when the other supporting rod 11 is pushed and rotated to make the shower curtain rod 1 bend inward or outward.

Figure 4:
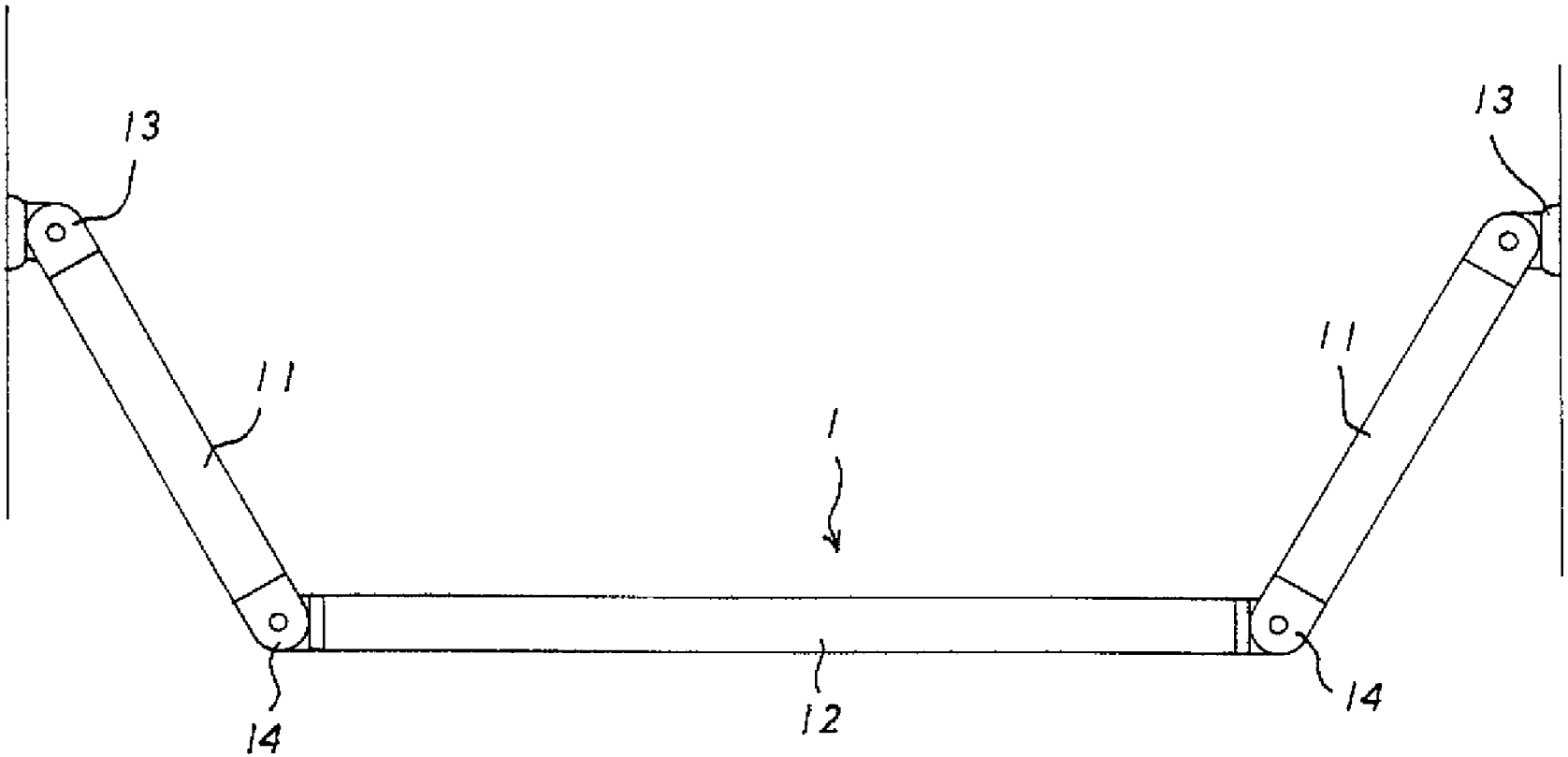
FIG. 4 is a first perspective operational view of the shower curtain rod.
Figure 5:
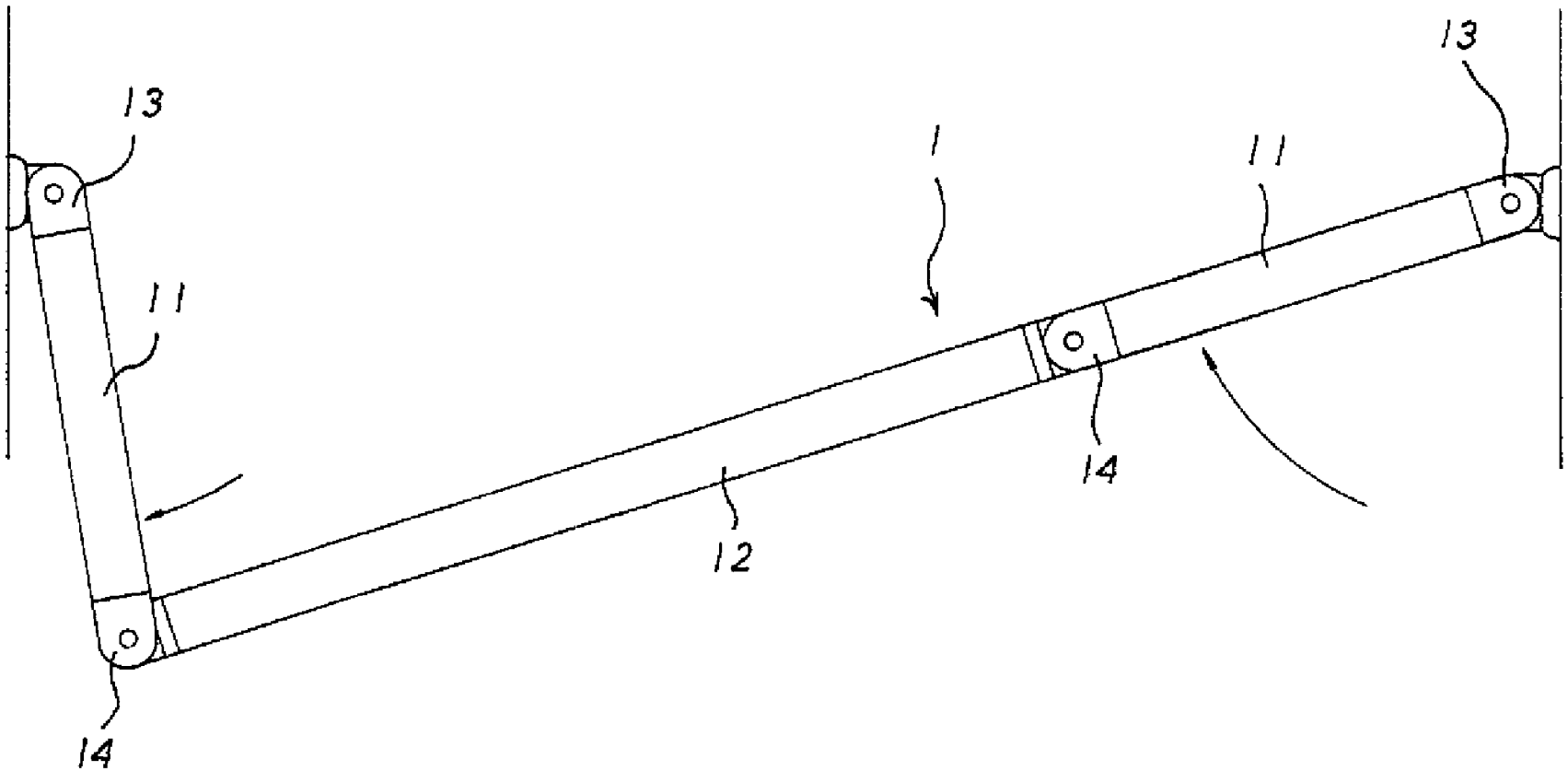
FIG. 5 is a second perspective operational view of the shower curtain rod following FIG. 4.
Figure 6:
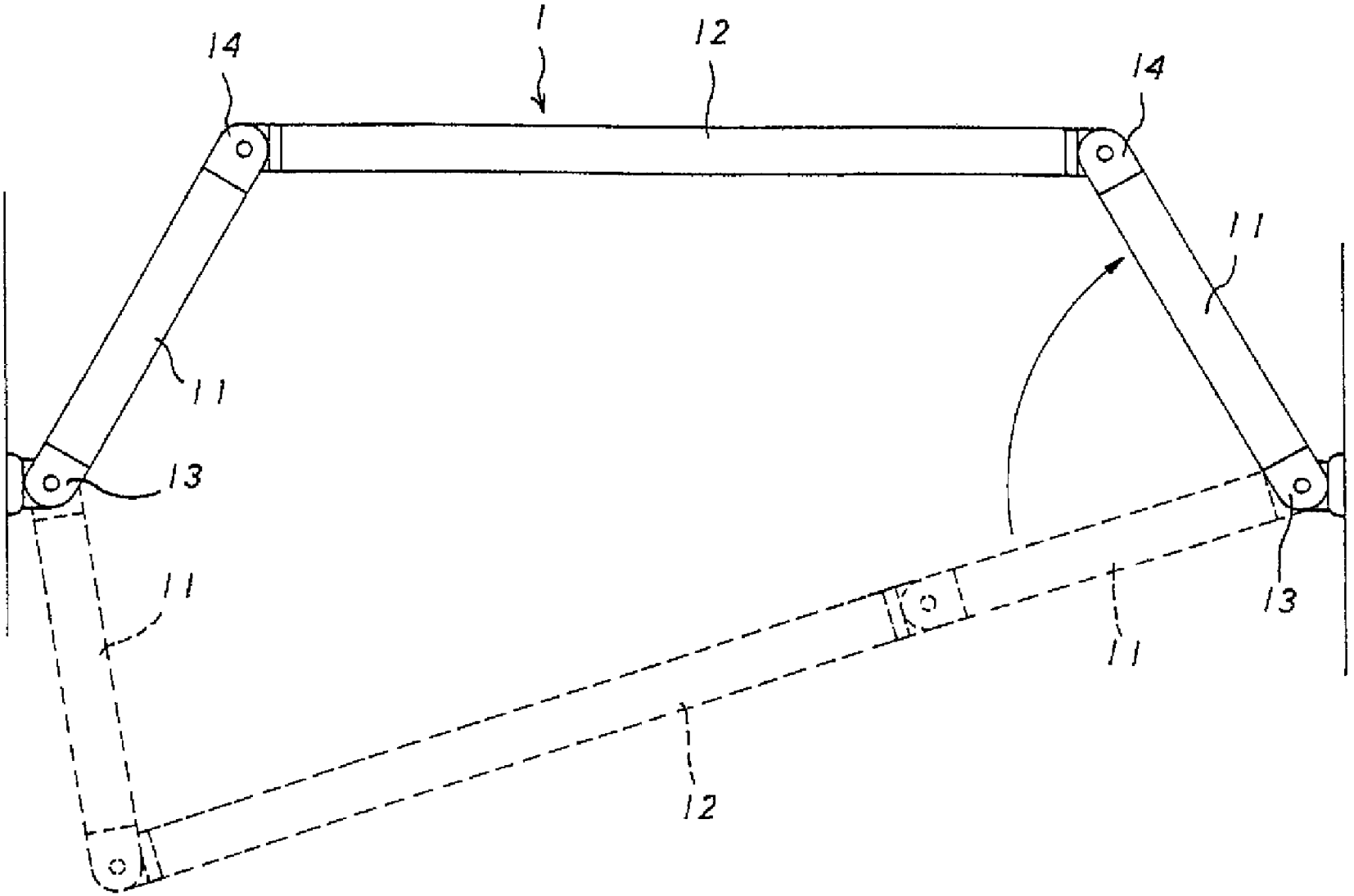
FIG. 6 is a third perspective operational view of the shower curtain rod following FIG. 5.
Figure 7:
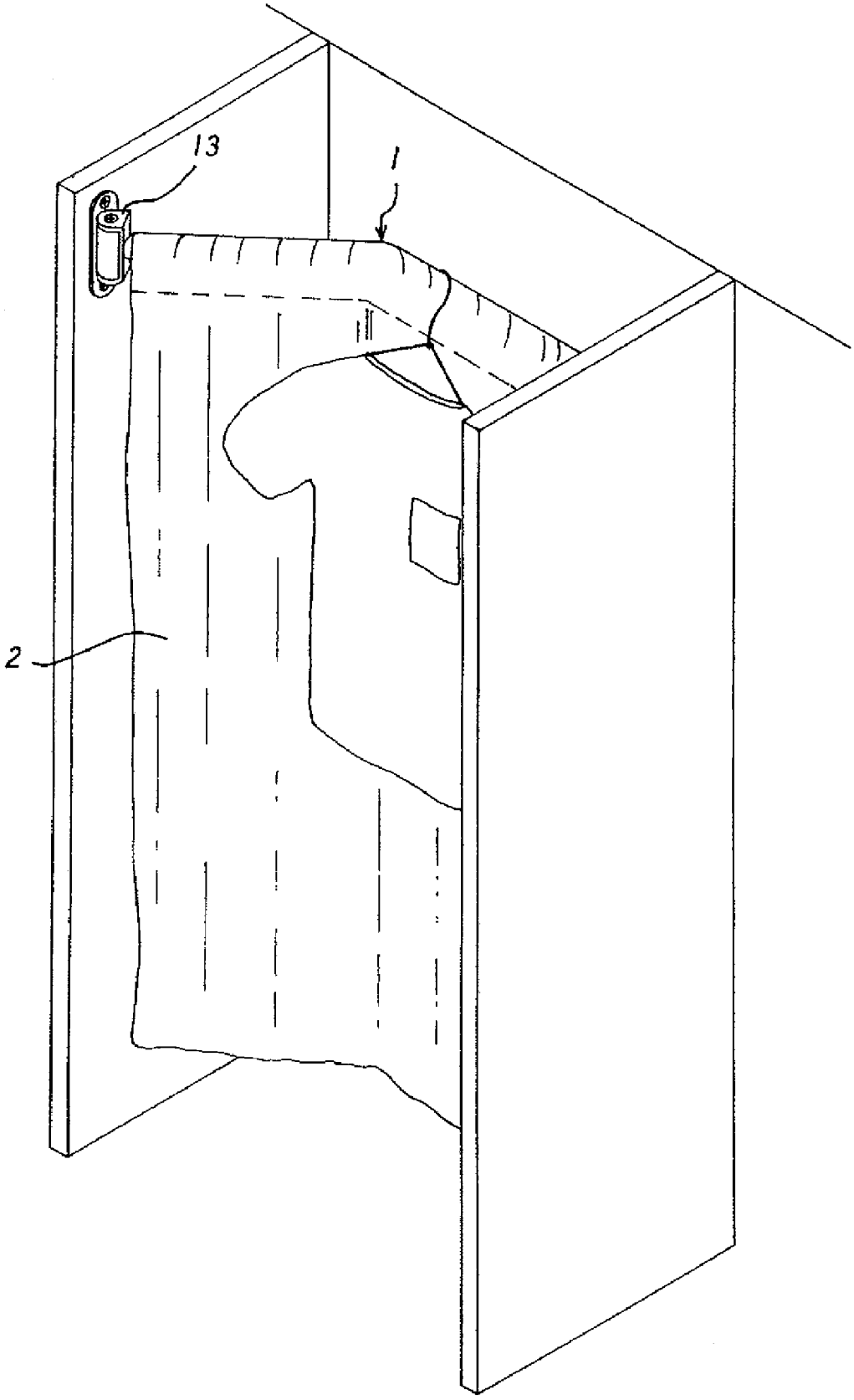
FIG. 7 is a perspective view of the shower curtain rod, wherein the shower curtain rod is placed inward the shower space.

Since the two supporting rods 11 and the extension rod 12 are connected by the pivoting joints 14 to form a multi-linkage structure and since the two supporting rods 11 are pivotally attached to the walls by the pivotal hinge assemblies (as shown in FIG. 4), the shower curtain rod 1 in a form of a multi-linkage is capable to bend and move inward or outward in operation. Therefore, when the shower room is occupied, the shower curtain rod is preferably bent outward to increase the shower space and to make a shower curtain 2 enclose the shower space for a user taking a shower. After showering, the shower curtain rod 1 should be bent inward to diminish the shower space. With reference to FIGS. 5 to 7 to show the operation of shower curtain rod 1, one supporting rod 11 is pushed inward (the driving supporting rod) to make the extension rod 12 incline into shower space. Meanwhile, the extension rod 12 drives the other supporting rod 11 (the driven supporting rod) to slightly move outward to allow the extension rod 12 and the driving supporting rod 11 to get straight when the extension rod 12 shifts its orientation. Until the joint of the extension rod 12 and the driving supporting rod 11 moves to an inner position, the extension rod 12 is driven entirely inward along with the driven supporting rod 11. Lastly, the shower curtain rod 1 is bent inward completely inside the shower space to achieve the unused status close to the inner wall to save more space. As shown in FIGS. 6 and 7, the saved space can be utilized for other functions such as suspending clothes. Therefore, the whole shower curtain 2 with the shower curtain rod 1 is accommodated inside a shower space/stall close to the inner wall to cause no obstruction to a limited interior inside a camping car. Thus, the user can have more convenience to walk inside the limited interior.

Each of the ends of the supporting rods 11 and the extension rod 12 has a securing hole 111, 121 to engage with a corresponding pivoting joint 14 or connecting joint 13 by a screw to provide fixing efficiency. To make the supporting rods 11, the extension rod 12, the pivoting joints 14 and connecting joints 13 to be assembled easily, the pivoting joints 14 and the connecting joints 13 respectively have recesses 142, 132 defined on the insertion ends 141, 131 to accommodate stubs caused by punching of the securing holes 111, 121 during manufacturing.

According to above description, the shower curtain rod 1 has significant capability for retrieval back into the shower stall/space, because the shower curtain rod 1 has four pivotal joints to provide flexibility thereto. When the shower curtain rod 1 is at the storage situation while the shower stall/space is unused, the saved space provides benefits such as more functional variation or increased living space for users.

Although this invention has been described in its preferred form with a certain degree of particularity, it is understood that the present invention of the preferred form has been made only by way of example and that numerous changes in the details of construction and the combination and arrangement of parts may be resorted to without departing from the spirit and scope of the invention.

What is claimed is:

1. A shower curtain rod comprising:

two supporting rods, wherein the two supporting rods are pivotally mounted on two walls by two pivotal hinge assemblies respectively;

wherein each of the two pivotal hinge assemblies comprises:

a pivotal post adapted to mount on one of the two walls; and a connecting joint pivotally mounted to the pivotal post about a joint axis and connected to a distal end of one of the two supporting rods; and at least one extension rod pivotally connected to and between the two supporting rods about first and second rod axes parallel to and spaced from each other and the joint axis of each connecting joint wherein each connecting joint has a bracket end clamping the corresponding pivotal post, wherein each connecting joint has an insertion end, with each supporting rod being a tube, with the insertion end inserted into the distal end;

wherein the insertion end on each of the connecting joints of the two pivotal hinge assemblies has a recess, and the corresponding distal end of the one of the two supporting rods has a securing hole aligning with the recess on the connecting joint; and wherein the at least one extension rod is a tube and is pivotally connected to the two supporting rods by two pivoting joints at ends, wherein each of the two pivoting joint comprises: a bracket end pivotally clamping a distal flatten flattened head of the extension rod; and an insertion end extending from the bracket end and inserted into a corresponding end of one of the two supporting rods.

2. The shower curtain rod as claimed in claim 1, wherein the insertion end on each of the two pivoting joints has a recess; and the corresponding end of the one of the two supporting rods has a securing hole aligning with the recess.

* * * * *